United States Patent [19]

Luce

[11] 3,997,863

[45] Dec. 14, 1976

[54] HELICALLY WOUND PITCH-DETERMINING ELEMENT FOR ELECTRONIC MUSICAL INSTRUMENT

[75] Inventor: David A. Luce, Clarence Center, N.Y.

[73] Assignee: Norlin Music, Inc., Lincolnwood, Ill.

[22] Filed: Apr. 3, 1975

[21] Appl. No.: 564,753

[52] U.S. Cl. ..... 338/69; 84/1.01; 84/DIG. 7; 338/92; 338/302

[51] Int. Cl.[2] ..... H01C 9/00

[58] Field of Search ..... 338/69, 92, 153, 154, 338/302, 303; 200/166 J; 84/1.01, 1.09, 1.1, 1.27, DIG. 7

[56] References Cited

UNITED STATES PATENTS

| | | | |
|---|---|---|---|
| 3,624,583 | 11/1971 | Nakada | 338/69 |
| 3,624,584 | 11/1971 | Ohno | 338/69 |
| 3,626,350 | 12/1971 | Suzuki et al. | 338/69 |
| 3,699,492 | 10/1972 | Yoshihara | 338/69 |
| 3,811,030 | 5/1974 | Veach | 338/302 X |

*Primary Examiner*—Volodymyr Y. Mayewsky
*Attorney, Agent, or Firm*—Hill, Gross, Simpson, Van Santen, Steadman, Chiara & Simpson

[57] ABSTRACT

A control apparatus for determining the pitch of the sound produced by an electronic music synthesizer incorporates a conductive ribbon having a manually adjustable contact with a second conductive element, the second element comprising an elongate helically wound resistance element supported by being cemented in a groove in a base member.

10 Claims, 6 Drawing Figures

HELICALLY WOUND PITCH-DETERMINING ELEMENT FOR ELECTRONIC MUSICAL INSTRUMENT

BACKGROUND OF THE INVENTION

1. Field of the Invention

The present invention relates to a ribbon element for controlling the pitch of an electronic synthesizer of the like.

2. The Prior Art

It has become conventional in some applications of electronic synthesizers and other electronic musical instruments to permit the pitch or timbre of a sound to be determined by the operator or player of such instrument by depressing an elongate conductive member into contact with another conductive member. The place at which contact is established determines the magnitude of the quantity, much as the pitch of a stringed instrument is determined by the location at which the string is depressed.

Typically, a conductive ribbon is supported in generally parallel fashion relative to an elongated conductive wire supported on the surface of a base member. The wire is a resistance element, and the resistance included within a closed electrical circuit is dependent upon the position of the ribbon which is in electrical contact with the wire. Although this arrangement has proven eminently satisfactory for permitting a player to determine easily and quickly any pitch he desires during the playing of the instrument, the stress on the resistance wire which results from continuous and/or repeated playing of the instrument on manipulating the ribbon element has proven to be quite destructive, and the unit must be repaired to replace the resistance wire on a relatively frequent basis. There is therefore a need for a different design of pitch determining element in which the problem of repeated and frequent breakage of the wire is averted.

SUMMARY OF THE INVENTION

It is a principal object of the present invention to provide a pitch determining element having a resistance element which is more durable and less subject to breakage than the resistance elements used in the past.

A further object of the present invention is to provide a control unit having a movable ribbon associated with a resistance element in which the resistance element is larger in cross section and is supported in relation to the surface of a base member by being cemented into a groove in said surface.

Other objects and advantages of the present invention will become manifest upon a review of the following description and the accompanying drawings.

In one embodiment of the present invention there is provided a ribbon control element for permitting an operator to select a variable resistance electrical circuit comprising a base member, means secured to the base member for supporting a conductive ribbon generally parallel and spaced from a surface of said base member, and a resistance element supported on said surface, said resistance element comprising a helically would wire supported on an elongate rod, said rod and wire assembly being cemented into a groove provided in said surface and extending in a direction generally parallel with said ribbon.

BRIEF DESCRIPTION OF THE DRAWINGS

Reference will now be made to the accompanying drawings, in which.

DESCRIPTION OF THE PREFERRED EMBODIMENT

Figure 1:
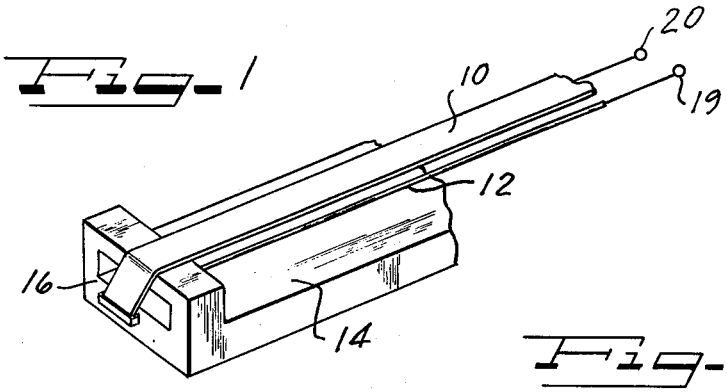
FIG. 1 is a perspective view of a portion of a control element constructed in accordance with the present invention.

Referring now to the drawings, FIG. 1 illustrates a ribbon control element which may be used by an operator to determine the pitch of a tone produced by an electronic music synthesizer or the like by depressing a ribbon 10 at a selected portion along its length so that it comes into electrical contact with a conductive resistance member 12 therebelow. The resistance member 12 is supported on the upper surface of a base member 14. An end assembly 16 at each end of the base member 14 supports an end of the ribbon 10, and at one end of the base member a pair of terminals 18 and 20 are in electrical contact with the resistance element 12 and the ribbon 10, respectively, by which the unit can be connected to an external electric circuit. The resistance in the circuit is determined largely by the length of the resistance element 12 which is electrically included between the terminals 18 and 20 (i.e., the effective length of the resistance element). The resistance of the ribbon element 10 is much less than that of the resistance element 12, so that the length of the ribbon element 10 is substantially without effect in determining the resistance in the circuit.

The effective length of the resistance element 12 is wholly dependent upon the portion of the ribbon 10 which is depressed into contact with the element 12 by the fingers of the operator or player. Players quickly develop sufficient skill to be able to determine any desired pitch by depressing the ribbon at the appropriate location. If desired, the ribbon element 10 may be marked with indications along its length of the places where it should be depressed to produce given tones, much as the frets of a stringed instrument.

Figure 2:
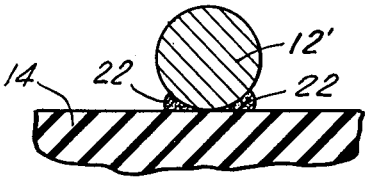
Fig. 2 (PRIOR ART)
FIG. 2 is a partial cross section of a resistance element constructed in accordance with the prior art.

In FIG. 2 a cross section of a portion of a prior art device is illustrated in which the resistance element 12' is mounted on top of a plane upper surface of the base 14, being glued with wedges of glue 22 interposed between the resistance element 12' and the base 14. The diameter of the resistance element 12' is necessarily relatively small in order to give a relatively large amount of resistance per unit length of the element. The combination of the small size of the element and its method of attachment, which is also dictated by its small size, means that the element is relatively fragile, and its connection with the surface of the base member is also easily broken. When the glue or cement areas 22 become detached, any force applied to the resistance element 12′ by virtue of contact with the ribbon element of the device serves easily to stretch the resistance element beyond its breaking point and renders the device unusable.

Figure 3:
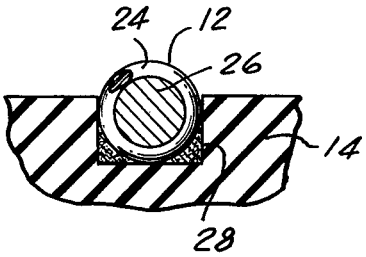
FIG. 3 is a partial cross section of a portion of a pitch determining element constructed in accordance with the present invention.

FIG. 3 is a partial cross section of an improved arrangement incorporating the present invention. The resistance element 12 comprises a helically wound wire 24 which is wound on a supporting rod 26. Because of the helical configuration of the wire 24, it must be considerably longer than the rod 26, and so it can also be made greater in cross section in order to give a given amount of resistance per unit length. The rod 26 upon which it is would also contributes to the size of the assembly, and makes it possible to mount the assembly in a groove 28 provided in the upper surface of the base member 14, with the same amount of projection of the resistance member 12 above the upper surface of the base. The groove, together with the larger size of the element, creates a much greater amount of surface contact which is possible for the cement 28 so that the assembly is held in much more rigid fashion in association with the base member than has heretofore been possible.

Actual demonstrations of the apparatus according to the present invention have revealed that there is substantially no stepwise change in a tone produced in response to a change in resistance by the use of the present invention, even though connection between the ribbon and discrete turns of the helically wound resistance element suggest that there would be such a stepwise progression of tones. In actual fact, any such a stepwise progression of tones is made up of steps so small in height that there are no steps which are noticeable to a listener.

Figure 6:
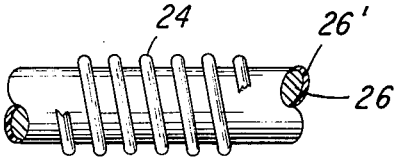
FIG. 6 is a side view of a portion of another embodiment of the invention.
Figure 5:
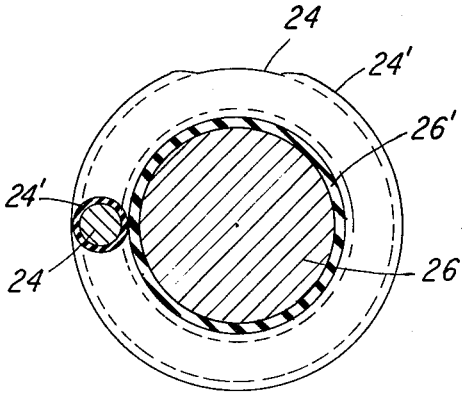
FIG. 5 is an enlarged transverse cross-section of a portion of one embodiment of the invention.

The rod 26 on which the resistance element is wound is preferably a nonconductor and may conveniently be formed of aluminum with an oxide coating 26′ applied to its surface by anodizing or the like (FIG. 5). The oxide coating has a relatively high resistance and does not function to short-circuit successive turns of helical winding. In addition, the helical resistance wire 24 is coated with a thin layer of insulating material 24, to insulate adjacent convolutions of the helix. This coating is removed on the upper portion of the resistance element, so the ribbon can establish electrical contact with the wire 24. Alternatively, adjacent convolutions of the helix are slightly spaced apart so that they do not touch each other (FIG. 6).

Figure 4:
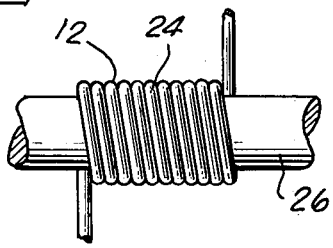
FIG. 4 is a fragmentary elevation of a portion of the resistance element, with a portion of the resistance wire being unwound from its supporting rod.

FIG. 4 illustrates, in partially disassembled form, how the resistance element 12 is wound on the supporting rod 26 during the formation.

It is apparent from the foregoing that the present invention provides a much improved assembly for the construction of a ribbon pitch controlling element, in which the resistance element of the control device is more rigidly secured to the base member, and which is much more durable and highly resistant to breaking during normal operation of the device. It will be apparent to those skilled in the art that various additions and modifications may be made without departing from the essential features of novelty of the present invention, which are intended to be defined and secured by the appended claims.

What is claimed is:

1. A pitch determining element for an electronic musical instrument, comprising an insulating base member, a resistance element rigidly supported on said base member, and a flexible electrically conductive member supported by said base member in close spaced, generally parallel relation to said resistance element, said resistance element comprising a supporting rod and a helix of resistance wire wound about and supported on said supporting rod, adjacent convolutions of said helix being insulated from each other.

2. Apparatus according to claim 1, wherein said supporting rod has a circular cylindrical surface for supporting said helix, said surface being formed of insulating material.

3. Apparatus according to claim 2, wherein said supporting rod is formed of aluminum and said surface is formed of an insulating oxide of aluminum.

4. Apparatus according to claim 1, including a groove in the upper surface of said base, said resistance element being cemented in place in said groove, and protruding upwardly therefrom above the adjacent upper surface of said base.

5. A pitch determining element for an electronic musical instrument comprising a base member formed of insulating material, said base member having a groove therein, a resistance element rigidly mounted in said groove, a flexible electrically conductive member, and means for supporting said flexible conductive member in close spaced, generally parallel relation to said resistance element, said resistance element comprising a supporting rod having an insulating surface and a helix of resistance wire wound about said insulating surface of said rod.--

6. In a pitch determining controller element for an electronic musical instrument having an elongate resistance member and a flexible electrically conductive ribbon supported in close spaced, generally parallel relation to said resistance element and adapted to make electrical contact with said resistance element under manual control of an operator, the improvement in said resistance element, comprising a supporting rod having an insulating surface, and a helix of resistance wire wound about and supported on said insulating surface of said rod.

7. A pitch determining element for an electronic musical instrument comprising an insulating base member, a resistance element supported on said base member, a flexible electrically conductive member, and means for supporting said flexible conductive member in close spaced generally parallel relation to said resistance element, said resistance element comprising a supporting rod having an insulating coating and a helix of resistance wire wound about and supported by said insulating coating of said rod.

8. A pitch-determining element for an electronic musical instrument, comprising an insulating base member, a resistance element rigidly supported on said base member, and a flexible electrical conductive member supported by said base member in close spaced, generally parallel relation to said resistance element, said resistance element comprising an insulating supporting rod and a helix of resistance wire wound about and supported on said supporting rod.

9. A pitch-determining element for an electronic musical instrument, comprising an insulating base member, a resistance element rigidly supported on said base member, and a flexible electrical conductive member supported by said base member in close spaced, generally parallel, relation to said resistance element, said resistance element comprising a supporting rod and a helix of resistance wire wound about and supported on said supporting rod, said resistance wire having a thin insulating coating, said coating being removed from the surface portions of said helix which face said conductive member.

10. Apparatus according to claim 9, including a groove in the upper surface of said base, said resistance element being cemented in place in said groove, and protruding upwardly therefrom above the adjacent upper surface of said base.

* * * * *